United States Patent [19]

Taniyama

[11] Patent Number: 4,951,936

[45] Date of Patent: Aug. 28, 1990

[54] SEPARATION UNIT

[75] Inventor: Yoshiharu Taniyama, Yokohama, Japan

[73] Assignee: Kabushiki Kaisha Toshiba, Kawasaki, Japan

[21] Appl. No.: 277,326

[22] Filed: Nov. 29, 1988

[30] Foreign Application Priority Data

Nov. 30, 1987 [JP] Japan ..... 62-302630
Nov. 30, 1987 [JP] Japan ..... 62-302631

[51] Int. Cl.[5] ..... B65H 29/56

[52] U.S. Cl. ..... 271/307; 271/308; 271/311; 271/312; 271/313; 271/900

[58] Field of Search ..... 271/308, 307, 311, 312, 271/313, 900

[56] References Cited

U.S. PATENT DOCUMENTS 4,252,310 2/1981 Kono et al. ..... 271/900 X
4,285,507 8/1981 Marinoff ..... 271/308 X
4,748,473 5/1988 Tsuruoka ..... 271/308 X

FOREIGN PATENT DOCUMENTS 58-53547 12/1983 Japan .

*Primary Examiner*—Kevin P. Shaver
*Assistant Examiner*—David H. Bollinger
*Attorney, Agent, or Firm*—Foley & Lardner, Schwartz, Jeffery, Schwaab, Mack, Blumenthal & Evans

[57] ABSTRACT

A separation unit includes separation pawls for separating paper from a photosensitive drum, and a second shaft for supporting the separation pawls. Each separation pawl has a mounting hole extending therethrough and a slit opening the mounting hole. The second shaft has a mounting portion which cannot pass through the slit and a chamfered portion which is formed continuous with the mounting portion. The portion of shaft where the chamfered portion is formed can pass through the slit. An annular bush is loosely fitted on the second shaft so as to be pivotal and movable from the mounting portion to the chamfered portion. The bush is detachably fitted in the hole of the separation pawl and supports the separation pawl. A holder is attached to the second shaft so as to regulate the movement of the bush toward the chamfered portion of the second shaft when the pawl is used, and to allow the movement of the bush toward the chamfered portion of the second shaft when the pawl is attached/detached.

14 Claims, 5 Drawing Sheets

SEPARATION UNIT

BACKGROUND OF THE INVENTION

1. Field of the Invention

The present invention relates to a separation unit for separating recording paper from a photosensitive drum or a fixing roller of, e.g., an electronic copying machine.

2. Description of the Related Art

For example, an electronic copying machine has a photosensitive drum rotated in a predetermined direction. An image forming unit for forming a toner image, a transfer charger for transferring the toner image onto paper, a separation charger for electrically separating the paper attracted to the photosensitive drum by an electrostatic force during transfer of the image, and a cleaning unit for removing a residual toner which is not transferred to the paper and left on the surface of the photosensitive drum are arranged around the photosensitive drum. In addition, separation pawls are arranged between the separation charger and the cleaning unit.

Each separation pawl has a through hole. A bush to be loosely fitted on a support shaft is urged/fitted in the through hole. With this arrangement, each separation pawl is pivotally attached to the support shaft. A bracket is fixed to the support shaft so as to regulate the movement of the separation pawl in the axial direction. The separation pawls attached in this manner are pivoted by a contacting/separating mechanism so as to be brought into contact with or separated from the surface of the photosensitive drum, and at the same time are reciprocated by a reciprocating mechanism in the axial direction of the photosensitive drum. With this operation, the separation pawls mechanically separate the paper, which has been subjected to the transfer operation by the transfer charger and the electrically separating operation by the separation charger, from the photosensitive drum. This operation prevents occurrence of a jam due to the entrance of paper into the cleaning unit.

In such an attachment structure, however, if, for example, a separation pawl is damaged, the separation pawl alone cannot be detached from the support shaft without disassembling the overall separation unit. For this reason, a great deal of labor and time are required to replace the damaged separation pawl with a new one. In addition, a secondary accident may occur due to the disassembling operation of the separation unit.

SUMMARY OF THE INVENTION

It is an object of the present invention to provide a separation unit in which a separation pawl can be easily replaced with a new separation pawl without disassembling the overall separation unit.

According to an aspect of the present invention, there is provided a separation unit for separating paper from a paper carrier comprising a separation member for separating the paper from said carrier, said separation member having a hole extending therethrough and a slit opening said hole, and a support member for supporting said separation member, said support member having a first portion, fitted in said hole, for supporting said separation member, and a second portion, formed continuous with said first portion, for passing through said slit, so that said separation member is removed from said support member.

DETAILED DESCRIPTION OF THE PREFERRED EMBODIMENTS

An embodiment of the present invention will be described below with reference to the accompanying drawings.

Figure 1:
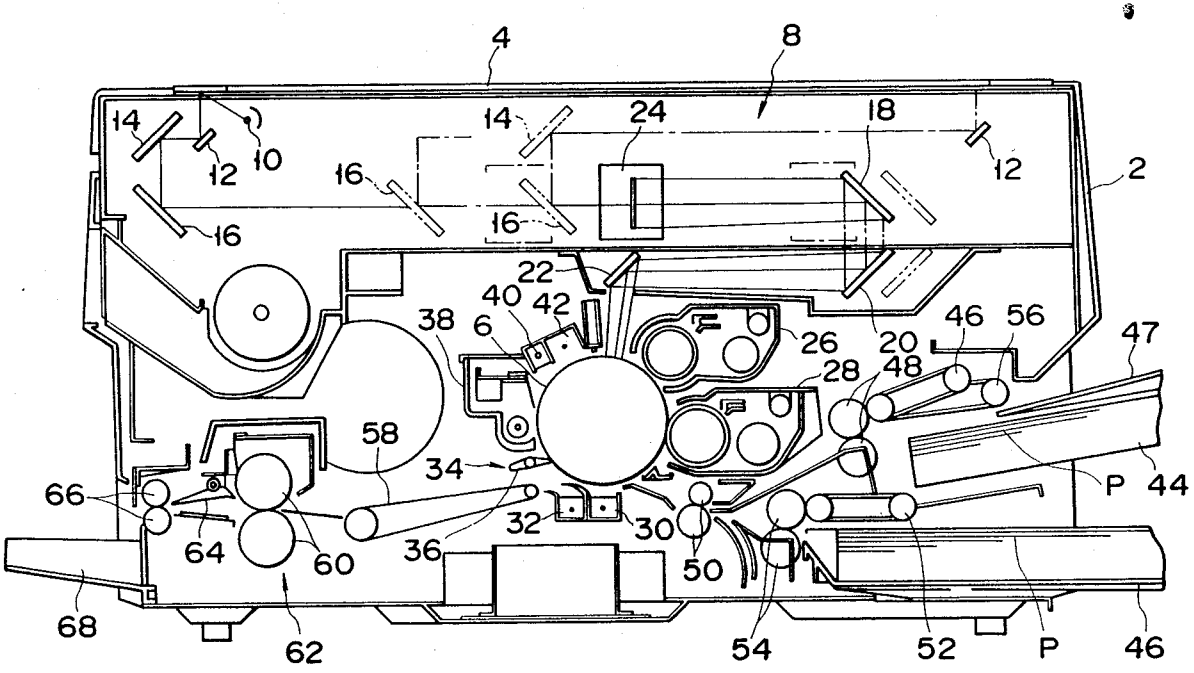
FIG. 1 is a schematic view showing an internal structure of an electronic copying machine using a separation unit.

FIG. 1 shows an electronic copying machine to which separation unit according to the present invention is applied. Reference numeral 2 denotes a housing. Document table 4 composed of transparent glass, on which a document is placed, is arranged on the upper surface of housing 2. Photosensitive drum 6 is rotatably supported by a shaft at substantially the center in housing 2.

Exposing unit 8 is arranged between photosensitive drum 6 and document table 4. Exposing unit 8 includes lamp 10, and first to sixth mirrors 12, 14, 16 18, 20, and 22. A document placed on document table 4 is irradiated/scanned with light from lamp 10. The light reflected by the document sequentially passes through first to third mirrors 12, 14, and 16, lens 24, and fourth to sixth mirrors 18, 20, and 22 in the order named, and is focused on photosensitive drum 6. During this scanning operation, lamp 10, and first to third mirrors 12, 14, and 16 are reciprocated in synchronism with rotation of photosensitive drum 6. In order to keep the optical path length from the document and photosensitive drum 6, second and third mirrors 14 and 16 are rotated at a speed ½ that of lamp 10 and first mirror 12.

First developing unit 26, second developing unit 28, transfer charger 30, separation charger 32, separation pawl 36 of separation unit 34, cleaner 38, discharge lamp 40, and charger 42 are sequentially arranged around photosensitive drum 6 along the rotating direction thereof in the order named from an image forming position defined by exposing unit 8.

The surface of photosensitive drum 6 is uniformly charged by charger 42. Then, the charged surface of photosensitive drum 6 is exposed by exposing unit 8. As result, an electrostatic latent image corresponding to the document is formed on the surface of photosensitive drum 6. A toner is supplied from at least one of first and second developing units 26 and 28 to the electrostatic latent image. With this operation, a toner image is formed. The toner image is transferred onto paper P by transfer charger 30. At this time, paper P is attracted to the surface of photosensitive drum 6 by an electrostatic force. The electrostatic force for attracting paper P to photosensitive drum 6 is attenuated upon AC corona discharge by separation charger 32. Subsequently, paper P is separated from the surface of photosensitive drum 6 by separation pawl 36. Residual toner on the surface of photosensitive drum 6, which is not transferred from photosensitive drum 6 onto paper P, is removed by cleaning unit 38. The potential on the surface of photosensitive drum upon cleaning is lowered by discharge lamp 40 below a predetermined level. With this operation, the next copy cycle is set to be ready.

Upper and lower paper feed cassettes 44 and 46 for storing paper P are inserted in a right side portion of housing 2. Manual paper insertion guide 48 for manually feeding paper P is formed on an upper surface of upper paper feed cassette 44. Paper P in upper paper feed cassette 44 is picked up by pickup roller 46 one by one, and is transferred by feed roller pair 48 to pair of aligning roller pair 50. Paper P in lower paper feed cassette 46 is picked up by pickup roller 52 one by one, and is transferred by a pair of feed rollers 54 to aligning roller pair 50. Paper P manually inserted from paper insertion guide 48 is transferred to aligning roller pair 50 through pickup roller 56 and feed roller pair 48. Aligning roller pair 50 aligns paper P and then transfers it to photosensitive drum 6 at a predetermined timing.

Paper P separated from photosensitive drum 6 is conveyed to fixing unit 62 having fixing roller pair 60 through conveyor belt 58. Fixing unit 62 fixes the toner image on paper P. Reference numeral 64 denotes a separation pawl for separating paper P from fixing roller pair 60. Paper P is then discharged onto discharge tray 68 outside housing 2 by a pair of discharge rollers 66 arranged on a left side portion.

Figure 2:
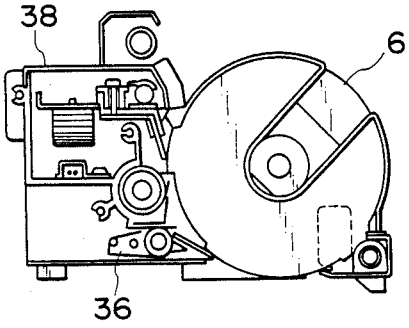
FIG. 2 is a view showing a cleaning unit and its peripheral parts of the electronic copying machine in FIG. 1.

As shown in FIG. 2, separation pawl 36 is incorporated in a lower portion of cleaning unit 38. Part of reciprocating mechanism 70 and contacting/separating mechanism (both of which will be described later) are incorporated in cleaning unit 38.

Figure 3:
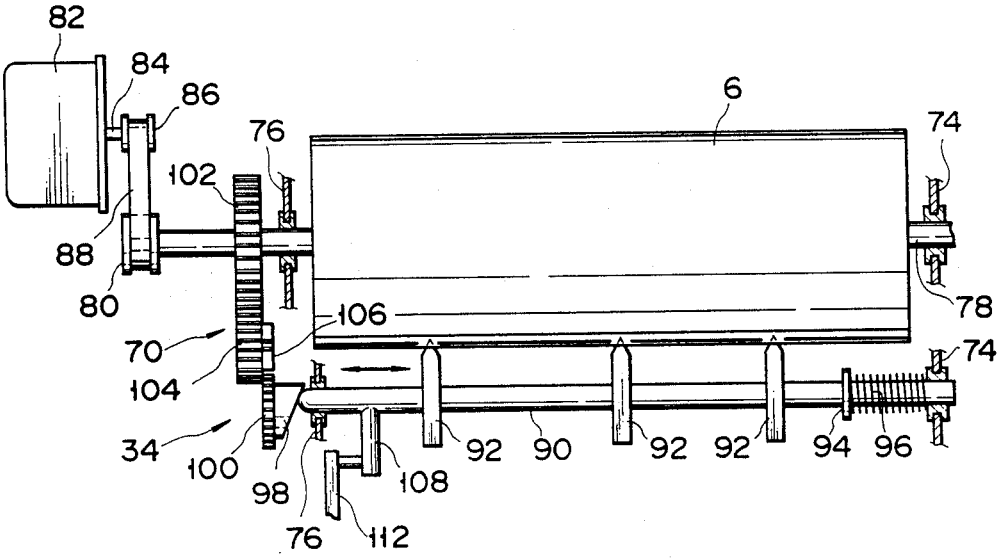
FIG. 3 is a plan view of the separation unit according to the present invention.
Figure 4:
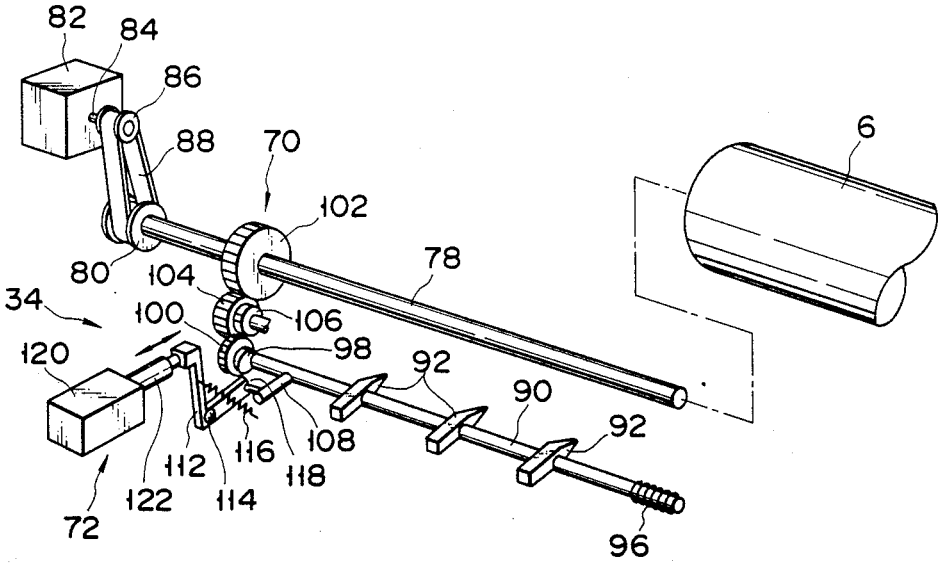
FIG. 4 is a perspective view of the separation unit in FIG. 3.

As shown in FIGS. 3 and 4, photosensitive drum 6 is fixed to first shaft 78 interposed between front and rear frames 74 and 76. First shaft 78 extends from rear frame 74 to the rear side. Pulley 80 is attached to the rear end portion of first shaft 78. Motor 82 is arranged on the rear side of rear frame 76. Pulley 86 is attached to rotary shaft 84 of motor 82. Belt 88 is looped around pulleys 80 and 86.

Second shaft 90 is interposed between front and rear frames 74 and 76 so as to be parallel to first shaft 78 and to be pivotal and axially movable. A plurality of separation pawls 92 are mounted on second shaft 90 at predetermined intervals. Each separation pawl 92 is composed of, e.g., polyurethane resin having a hardness of 90 degrees (JIS standard) and a thickness of 1.5 mm. Separation pawls 92 are reciprocated by reciprocating mechanism 70 in the axial direction of photosensitive drum 6, and is brought into contact with or separated from photosensitive drum 6 by contacting/separating mechanism 72.

Figure 5A:
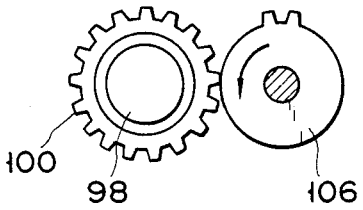
FIGS. 5A and 5B are views for explaining the operation of the reciprocating mechanism of the separation unit in FIG. 3.
Figure 5B:
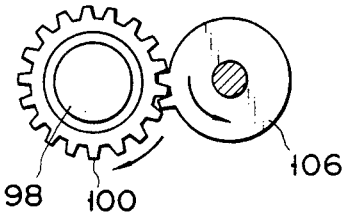

Reciprocating mechanism 70 is arranged in the following manner. Snap ring 94 is fixed to second shaft 90 on the front side. Spring 96 is interposed between snap ring 94 and front frame 74. With this arrangement, second shaft 90 is urged to the rear side. The rear end portion of second shaft 90 urged in this manner is brought into contact with inclined surface cam 98. Inclined surface cam 98 is coaxially fixed to an end face of gear 100. Gear 102 is fixed to first shaft 78 at a position between rear frame 76 and pulley 80. Gear 104 is meshed with gear 102. Intermittent gear 106 is coaxially fixed to an end face of gear 104. As shown in FIG. 5A, when teeth of intermittent gear 106 are not meshed with gear 100, gear 100 is stopped. When the teeth of intermittent gear 106 are meshed with gear 100 as shown in FIG. 5B, gear 100 is rotated. With this operation, inclined surface cam 98 is intermittently rotated by a predetermined amount. As a result, second shaft 90 is axially reciprocated.

Figure 6:
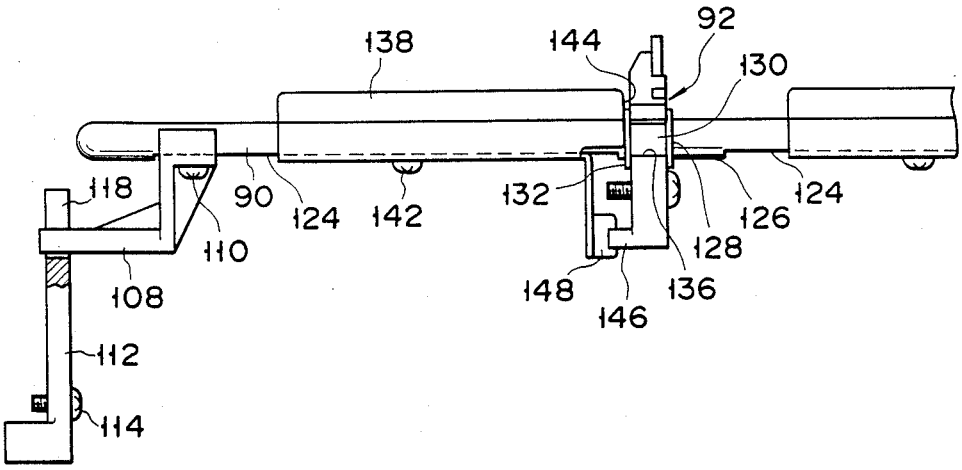
FIG. 6 is a plan view showing the attachment structure of a separation pawl of the separation unit in FIG. 3.

Contacting/separating mechanism 72 is arranged in the following manner. As shown in FIGS. 4 and 6, L-shaped lever 108 is fixed to second shaft 90 on the rear side by screw 110. Lever 108 is engaged with forked lever 112. Forked lever 112 is pivotally attached to pivot shaft 114 at its central portion, and is urged by spring 116 so as to be pivoted in a predetermined direction. U-shaped groove 118 is formed in one end of forked lever 112. The distal end of lever 108 is engaged with groove 118. Driving rod 122 of solenoid 120 is coupled to the other end of forked lever 112.

Figure 7:
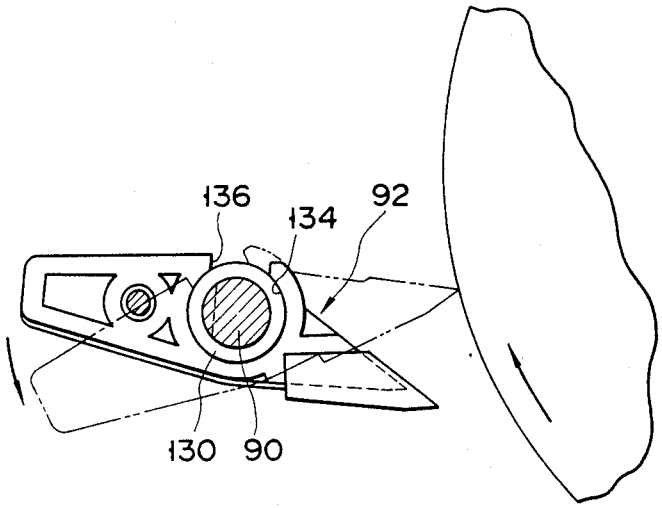
FIG. 7 is a front view showing a state wherein the separation pawl in FIG. 6 is attached.
Figure 8:
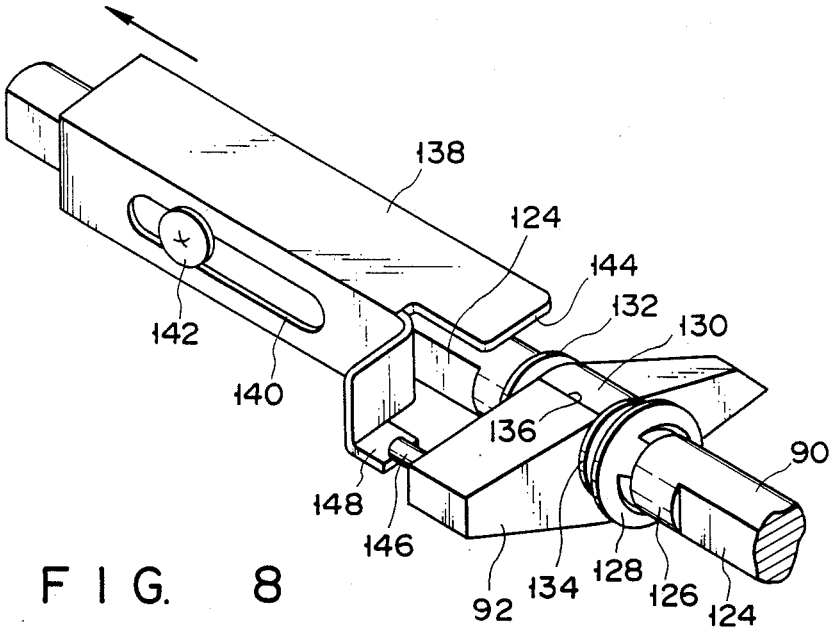
FIGS. 8 and 9 are perspective views for explaining the operation for detaching the separation pawl.

As shown in FIGS. 6 and 7, a plurality of planar chamfered portions 124 are formed on second shaft 90. Each portion of shaft 90 where chamfered portion 124 is formed has a D-shaped sectional area. A portion of shaft 90 without chamfered portion 124 is used as separation pawl mounting portion 126. Snap ring 128 for regulating the movement of separation pawl 92 toward the front side is fitted on mounting portion 126 so as not to be axially movable. In addition, annular bush 130 is pivotally and loosely fitted on mounting portion 126. Plain washer 132 is loosely fitted on mounting portion 126 on a side opposite to snap ring 128 through bush 130.

Mounting hole 134 is formed in each separation pawl 92. Bush 130 is urged/inserted in mounting hole 134. With this arrangement, separation pawl 92 is attached to second shaft 90 so as to be pivotal and axially movable. Separation pawl 92 is designed such that its proximal end portion is heavier than its distal end portion. Therefore, separation pawl 92 is brought into contact with the surface of photosensitive drum 6 by its own weight. In addition, slit 136 opening mounting hole 134 is formed in separation pawl 92.

Mounting portion 126 of second shaft 90 cannot pass through slit 136. The portion of second shaft 90 where chamfered portion 124 is formed can pass through slit 136.

Bracket 138 is attached to chamfered portion 124 of second shaft 90 by screw 142 inserted into elongated hole 140 formed in bracket 138 along the axial direction of second shaft 90. Bracket 138 includes stopper portion 144 for regulating the movement of separation pawl 92 toward the rear side. Therefore, the axial movement of separation pawl 92 is regulated by snap ring 128, and stopper portion 144 of bracket 138.

Pin 146 is formed on the rear side of separation pawl 92 so as to extend toward bracket 138. Engaging portion 148 to be engaged with pin 146 is formed in bracket 138. When second shaft 90 is rotated clockwise in FIG. 7, engaging portion 148 is rotated clockwise so as to be engaged with pin 146, thereby urging/pivoting pin 146 clockwise. As a result, the distal end of separation pawl 92 is separated from photosensitive drum 6. When second shaft 90 is rotated counterclockwise in FIG. 7, engaging portion 148 is pivoted counterclockwise, i.e., a direction to be separated from pin 146. Consequently, each separation pawl 92 is pivoted counterclockwise by its own weight. As a result, the distal end of each separation pawl 92 is separated from photosensitive drum 6.

When solenoid 120 is energized, therefore, forked lever 112 is pivoted against the urging force of spring 116. With this operation, separation pawl 92 is brought into contact with the surface of photosensitive drum 6, as indicated by an imaginary line in FIG. 7. When solenoid 120 is deenergized, forked lever 112 is pivoted by the urging force of spring 116. As a result, separation pawl 92 is separated from the surface of photosensitive drum 6, as indicated by a solid line in FIG. 7.

Solenoid 120 is energized and deenergized at timings allowing separation pawl 92 to be brought into contact with the surface of photosensitive drum 6 at a position several tens of millimeters ahead of a contact start point, at which the leading edge of paper P transferred by aligning roller pair 50 is brought into contact with the surface of photosensitive drum 6, in the rotating direction of photosensitive drum 6, and allowing separation pawl 92 to be separated from the surface of photosensitive drum 6 at a position several tens of millimeters backward from the contact start point in the rotating direction of photosensitive drum 6.

Figure 9:
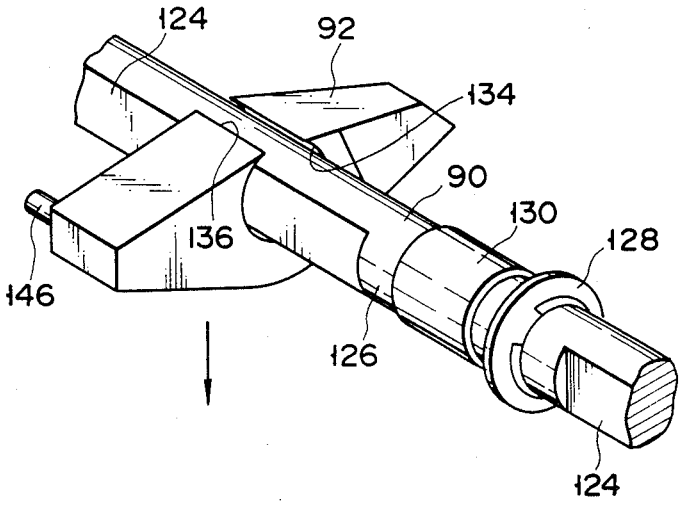

According to the above-described arrangement, when separation pawl 92 is detached from second shaft 90, screw 142 is loosened so as to axially move bracket 138 toward the rear side, as shown in FIG. 9. Then, plain washer 132, bush 130, and separation pawl 92 are moved toward the rear side up to chamfered portion 124. Subsequently, bush 130 is pulled off from mounting hole 134 of separation pawl 92. Separation pawl 92 is moved along chamfered portion 124 in the direction opposite to notched portion 136. With this operation, second shaft 90 can pass through slit 136. As a result, separation pawl 92 is detached from second shaft 90. When separation pawl 92 is to be attached to second shaft 90, the procedures of the above operation are reversed. Therefore, separation pawl 92 can be easily replaced with a new one without disassembling overall separation unit 34.

In addition, since separation pawl 92 is brought into contact with or separated from the surface of photosensitive drum 6 at the predetermined timing, the time during which separation pawl 92 is brought into contact with the surface of photosensitive drum 6 can be reduced to a minimum time required to separate paper P from photosensitive drum 6. Therefore, a possibility that the surface of photosensitive drum 6 is damaged by contact with separation pawl 92 can be minimized.

Furthermore, since motor 82 for driving photosensitive drum 6 is used as a driving source of reciprocating mechanism 70 for separation pawl 92, the structure can be simplified, and the number of parts can be decreased Moreover, since part of reciprocating mechanism 70 and contacting/separating mechanism 72 are incorporated in cleaning unit 38, the structure can be further simplified, and the number of parts can be further decreased.

Note that the present invention is applied to separation unit 34 for separating paper P from photosensitive drum 6. However, the present invention is not limited to this, but can be applied to a separation unit for separating paper a from fixing roller 60 of fixing unit 62 by using separation pawl 64 (FIG. 1).

What is claimed is:

1. A separation unit for separating paper from a paper carrier, comprising:

a separation member for separating the paper from said carrier, said separation member having a hole extending therethrough and a slit opening said hole; and a support member for supporting said separation member, said support member having a first portion, fitted in said hole, for supporting said separation member, and a second portion, formed continuous with said first portion, for passing through said slit, so that said separation member is removable from said support member.

2. The unit according to claim 1, further comprising reciprocating means for reciprocating said separation member in a line perpendicular to the direction in which the paper is moved away from said carrier by said separation member, and moving means including means for selectively moving the separation member between a position in contact with, and a position separated from, the carrier.

3. The unit according to claim 2, wherein said moving means includes means for selectively moving the separation member between a position in contact with, and a position separated from, the carrier at times allowing said separation member to be brought into contact with said carrier at a portion separated by a predetermined distance from a start position at which separation of the paper from said carrier is started, and allowing said separation member to be separated from said carrier at a position separated by a predetermined distance from the start position at which separation of the paper is started.

4. The unit according to claim 1, further comprising means for driving said interlocked carrier and separation member.

5. A separation unit for separating paper from a paper carrier, comprising:

separation member for separating the paper from said carrier, said separation member having a hole extending therethrough and a slit opening said hole;

a support member for supporting said separation member, said support member having a first portion unable to pass through said slit and a second portion formed continuous with said first portion and able to pass through said slit, an annular portion loosely fitted on said support member so as to be pivotal and moveable from said first portion to said second portion and detachably fitted in said hole of said separation member so as to support said separation member; and regulating means for regulating movement of said annular member toward said second portion of said support member when said separation member is used, and allowing movement of said annular member toward said second portion of said support member when said separation member is attached to or detached from said support member.

6. The unit according to claim 5, wherein said separation member is pivoted about said support member by its own weight and is brought into contact with said carrier.

7. The unit according to claim 5, wherein said regulating means includes a first regulating member, fixed to said first portion of said support member for regulating movement of said annular member in a direction opposite to said second portion of said support member, and a second regulating member fixed to said second portion of said support member, for regulating movement of said annular member toward said second portion of said support member.

8. The unit according to claim 5, further comprising moving means for selectively moving said separation member between two positions, in contact with and separated from the carrier.

9. The unit according to claim 8, wherein said support member is pivotally mounted, and said moving means includes pivoting means for selectively pivoting said support member between first and second positions, and engaging means, arranged on said regulating means and adapted to be engaged with said separation member so as to bring said separation member into contact with said carrier when said support member is pivoted to the first position, and to be disengaged from said separation member when said support member is pivoted to the second position, and said separation means is brought into contact with said carrier when said engaging means is disengaged from said separation member.

10. The unit according to claim 8, wherein said moving means includes means for moving said separation member to said contact position at times which allow said separation member to contact said carrier at a position separated, in the traveling direction of the paper carried by said carrier, by a predetermined distance from the forward end of said paper, at which separation of the paper is started, and moving said separation member to said separated position after said forward end travels in said traveling direction by a predetermined distance beyond the position at which said separation member contacts said carrier.

11. The unit according to claim 5, wherein said support member is arranged to be movable along a line perpendicular to the direction in which the paper is moved away from said carrier by said separation member, and which further comprises reciprocating means for reciprocating said support member together with said separation member along said line.

12. The unit according to claim 11, wherein said reciprocating means includes a drive source, a reciprocating mechanism driven by said drive source to reciprocate said support member at a driving speed, and decelerating means for decreasing the driving speed of said drive source.

13. The unit according to claim 12, wherein said decelerating means includes means for intermittently transmitting a drive force of said driving source to aid the reciprocating mechanism, so as to decrease the driving speed of said support member.

14. The unit according to claim 12, which further comprises means for transmitting the drive force of said driving source to said carrier, so as to drive said carrier.

* * * * *